US009215518B2

(12) United States Patent
Lee et al.

(10) Patent No.: US 9,215,518 B2
(45) Date of Patent: Dec. 15, 2015

(54) ELECTRONIC DEVICE HAVING MICROPHONE DEVICE

(71) Applicant: Samsung Electronics Co., Ltd., Gyeonggi-do (KR)

(72) Inventors: Woo-Chul Lee, Gyeonggi-do (KR); Ju-Yong Kim, Gyeonggi-do (KR); Eun-Su Jeong, Gyeongsangnam-do (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 14/245,350

(22) Filed: Apr. 4, 2014

(65) Prior Publication Data

US 2015/0010192 A1 Jan. 8, 2015

(30) Foreign Application Priority Data

Jul. 4, 2013 (KR) ..... 10-2013-0078462

(51) Int. Cl.
*H04R 1/02* (2006.01)
*H04R 1/04* (2006.01)

(52) U.S. Cl.
CPC .. *H04R 1/02* (2013.01); *H04R 1/04* (2013.01); *H04R 2499/11* (2013.01); *H04R 2499/15* (2013.01)

(58) Field of Classification Search
CPC ..... H04R 2499/11; H04R 1/02; H04R 1/04; H04R 19/04; H04R 1/406; H04R 2499/15; H04M 1/03; H04M 1/035
USPC ..... 381/77, 79, 91, 333, 355, 361, 365; 455/575.3
See application file for complete search history.

(56) References Cited

U.S. PATENT DOCUMENTS

| | | | | |
|---|---|---|---|---|
| 3,800,089 | A * | 3/1974 | Reddick | 379/453 |
| 5,197,091 | A * | 3/1993 | Takagi et al. | 455/575.7 |
| 5,832,079 | A * | 11/1998 | Rabe | 379/433.13 |
| 6,091,964 | A * | 7/2000 | Frohlund | 455/575.3 |
| 6,965,790 | B1 * | 11/2005 | Mendolia | 455/575.3 |
| 7,010,333 | B2 * | 3/2006 | Trively | 455/575.3 |
| 7,272,423 | B2 * | 9/2007 | Satoh et al. | 455/575.3 |
| 7,349,723 | B2 * | 3/2008 | MacIntosh et al. | 455/575.1 |
| 7,369,882 | B2 * | 5/2008 | Hwang et al. | 455/575.1 |
| 7,417,865 | B2 * | 8/2008 | Kim | 361/727 |
| 7,526,326 | B2 * | 4/2009 | Vance et al. | 455/575.7 |
| 7,574,243 | B2 * | 8/2009 | Lee | 455/575.4 |
| 7,664,284 | B2 * | 2/2010 | Zhang et al. | 381/355 |
| 7,925,004 | B2 * | 4/2011 | Hodges et al. | 379/388.01 |
| 8,135,155 | B2 * | 3/2012 | Lan et al. | 381/333 |
| 8,311,255 | B2 * | 11/2012 | Hankey et al. | 381/361 |
| 8,588,858 | B2 * | 11/2013 | Shim et al. | 455/566 |
| 8,744,109 | B2 * | 6/2014 | Crooijmans | 381/355 |
| 2004/0137958 | A1 * | 7/2004 | Sawai | 455/566 |
| 2006/0238503 | A1 | 10/2006 | Smith et al. | |
| 2008/0240471 | A1 * | 10/2008 | Chen et al. | 381/150 |
| 2009/0116658 | A1 * | 5/2009 | An et al. | 381/71.1 |

(Continued)

*Primary Examiner* — Brian Miller
(74) *Attorney, Agent, or Firm* — The Farrell Law Firm, P.C.

(57) ABSTRACT

An electronic device having a microphone device is provided. The electronic device includes at least one case frame which forms the external appearance of the electronic device, at least one microphone device which is disposed in the at least one case frame, and at least one microphone hole which is formed in a position corresponding to the at least one microphone device of the at least one case frame, and is disposed in a region which is not visually exposed in the at least one case frame.

8 Claims, 6 Drawing Sheets

(56) References Cited

U.S. PATENT DOCUMENTS

2009/0156263 A1* 6/2009 Park et al. ..... 455/566
2009/0156273 A1* 6/2009 Romesburg et al. ..... 455/575.3
2013/0329915 A1* 12/2013 ANDRE et al. ..... 381/122
2014/0112517 A1* 4/2014 Farahani et al. ..... 381/365

* cited by examiner

ELECTRONIC DEVICE HAVING MICROPHONE DEVICE

PRIORITY

This application claims priority under 35 U.S.C. §119(a) to a Korean Patent Application filed in the Korean Intellectual Property Office on Jul. 4, 2013 and assigned Serial No. 10-2013-0078462, the entire disclosure of which is incorporated herein by reference.

BACKGROUND OF THE INVENTION

1. Field of the Invention

The present invention relates generally to an electronic device, and more particularly, to an electronic device having a microphone device.

2. Description of the Related Art

Electronic devices such as mobile terminals (cellular phones), electronic schedulers, personal complex terminals, TeleVisions (TVs), laptop computers, and tablet Personal Computers (PCs) have become necessities of current society based on the development of electronic communication industries. The electronic devices have become an important way of information transmission, which are updating fast. Each of these electronic devices facilitates a work of a user through a Graphic User Interface (GUI) environment using a touch screen and provides various multimedia based on a web environment.

Electronic devices have been developed to have various additional functions, such as a voice recognition function. A voice recognition function is used as a means of data input for recognizing a voice of a user and performing a predetermined operation, although the user does not input a specific instruction directly using a key input (e.g., touch input or button input, etc.). Manufacturers of the electronic devices have been competing with one another to have a better recognition rate.

In general, in order to perform voice recognition, each of the electronic devices has a microphone device including at least one microphone unit configured for collecting voices of the user. This microphone device receives voices of the user when the user talks with another using a speakerphone function, in addition to the voice recognition function.

The microphone device may receive external voices or sounds through a microphone hole of a certain shape, which is formed in a case frame of the electronic device. However, because this microphone hole is exposed to the outside of the electronic device, its functions may be deteriorated by foreign substances such as dust and water, and the external appearance of the electronic device may be affected by the microphone hole.

SUMMARY OF THE INVENTION

The present invention has been made to address at least the above-mentioned problems and/or disadvantages and to provide at least the advantages described below.

Accordingly, an aspect of the present invention is to provide an electronic device having a microphone device.

Another aspect of the present invention is to provide an electronic device having a microphone device for increasing its beauty of the external appearance and preventing damage due to foreign substances.

Another aspect of the present invention is to provide an electronic device having a microphone device for improving the reliability of an electronic device.

In accordance with one aspect of the present invention, an electronic device is provided. The electronic device includes at least one case frame which forms an external appearance of the electronic device, at least one microphone device which is disposed in the at least one case frame, and at least one microphone hole which is formed in a position corresponding to the at least one microphone device of the at least one case frame, wherein the at least one microphone hole is disposed in a region which is not visually exposed in the at least one case frame.

In accordance with another aspect of the present invention, an electronic device is provided. The electronic device includes a first structure, a second structure which is combined with the first structure, at least one microphone device which is installed in one of the first structure and the second structure; and at least one microphone hole which is formed in a position corresponding to the at least one microphone device, wherein the at least one microphone hole is disposed in a boundary portion of the first structure and the second structure.

BRIEF DESCRIPTION OF THE DRAWINGS

The above and other aspects, features and advantages of certain embodiments of the present invention will be more apparent from the following detailed description taken in conjunction with the accompanying drawings, in which.

DETAILED DESCRIPTION OF EMBODIMENTS OF THE PRESENT INVENTION

Various embodiments of the present invention will be described herein below with reference to the accompanying drawings. In the following description, well-known functions or constructions are omitted for clarity and conciseness. Also, the terms used herein are defined according to the functions of the present invention. Thus, the terms may vary depending on a user's or an operator's intention and usage. That is, the terms used herein must be understood based on the descriptions made herein.

In describing an embodiment of the present invention, a description will be given for, but is not limited to, an electronic device which may include a keypad having key buttons and have a link structure. For example, the electronic device may be one of a variety of devices, each of the devices including a microphone device, such as a Personal Digital Assistant (PDA), a laptop computer, a mobile phone, a smart phone, a netbook, a Mobile Internet Device (MID), an Ultra Mobile PC (UMPC), a tablet PC, a note PC, a navigation device, a Moving Picture Experts Group (MPEG) audio layer 3 (MP3) player, and a TV.

Hereinafter, a description will be given for an electronic device having a microphone device according to one embodiment of the present invention. The microphone device may include a plurality of microphone units disposed in the electronic device. The microphone device may be configured to electrically connect to a board of the electronic device.

Figure 1:
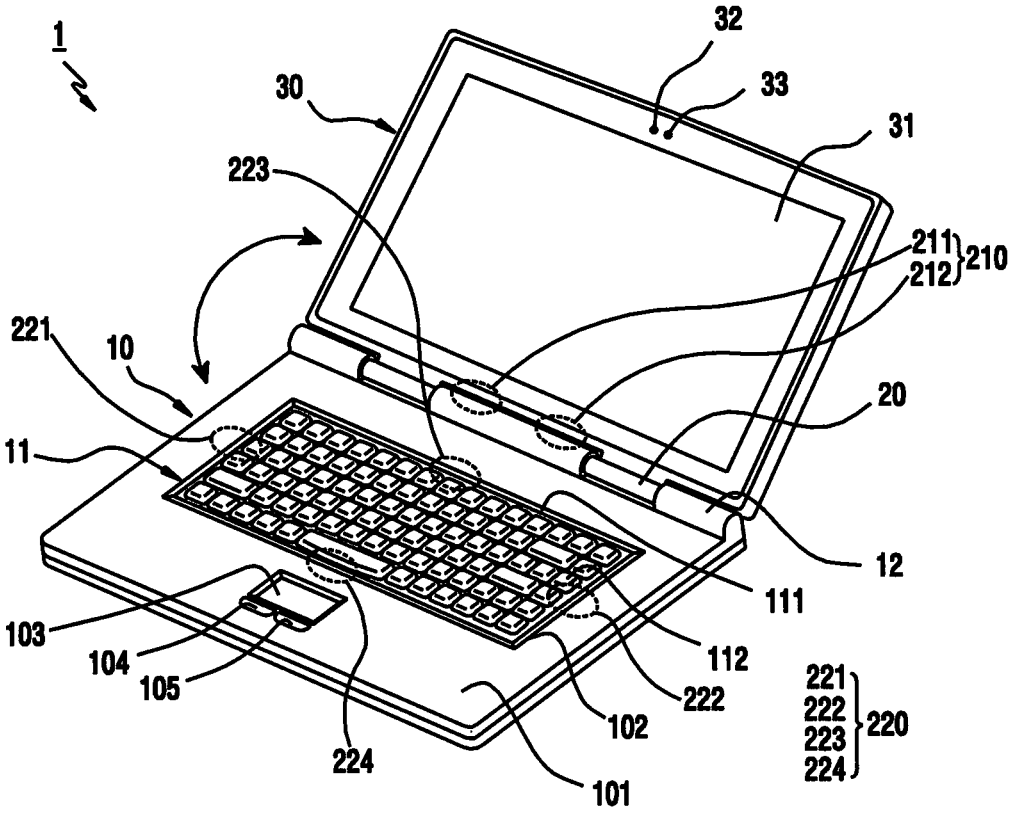
FIG. 1 is a front perspective view of an electronic device according to an embodiment of the present invention.
Figure 2:
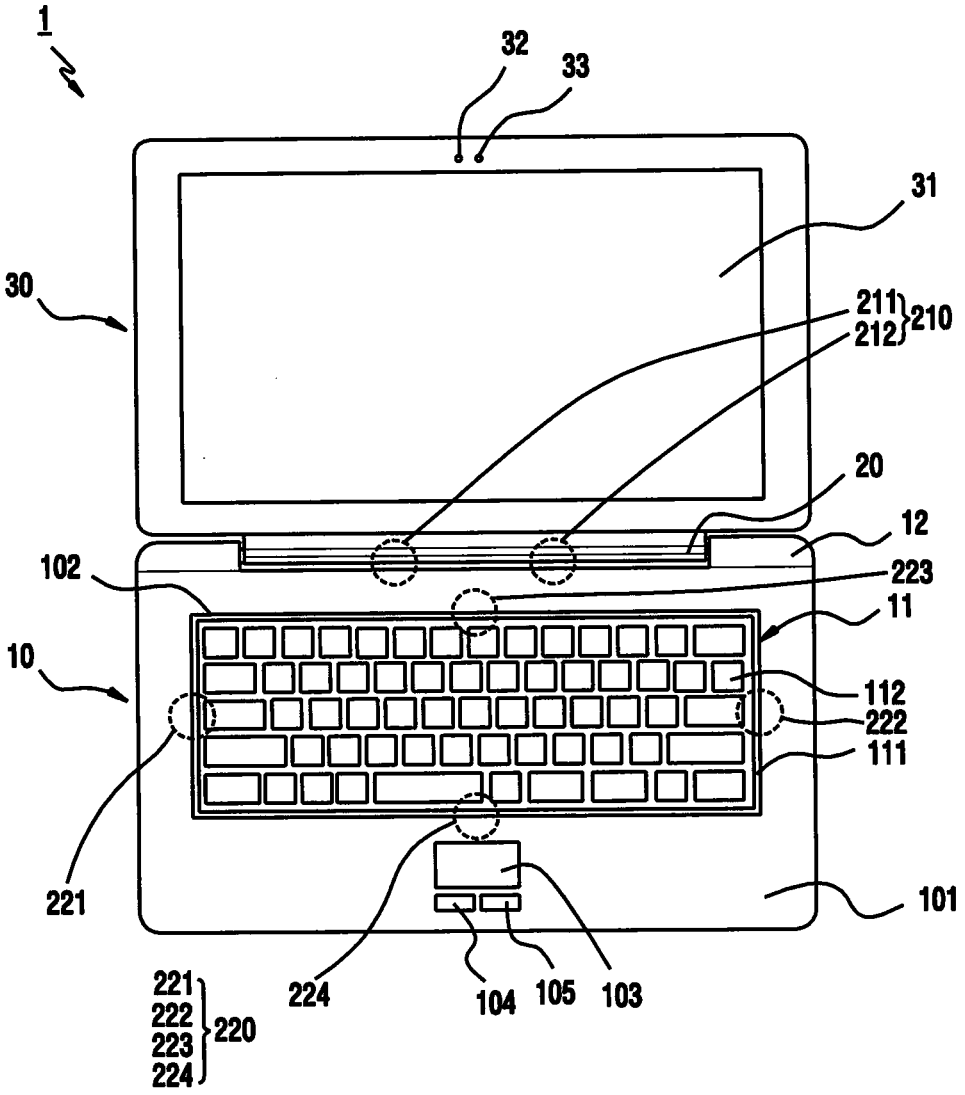
FIG. 2 is a front plan view of an electronic device according to an embodiment of the present invention.

FIG. 1 is a front perspective view of an electronic device according to an embodiment of the present invention. FIG. 2 is a front plan view of an electronic device according to an embodiment of the present invention.

A description will be given for, but is not limited to, a laptop PC as an electronic device 1. For example, the electronic device 1 may be any one of various electronic devices which may perform a voice call function or a speakerphone function.

As illustrated in FIGS. 1 and 2, the electronic device 1 may include a first case frame 10 having a keypad 11, a second case frame 30 having a display module 31, and a hinge part 20 for electrically connecting the first case frame 10 with the second case frame 30 and rotating the second case frame 30 at regular angles.

The first case frame 10 may have a rectangular shape. An external side of the first case frame 10 may be formed to be extended without a stepped difference. A keypad receiving groove 102 for receiving the keypad 11 having a plurality of key buttons 112 may be formed in a front surface 101 of the first case frame 10. A touch pad 103 for sensing touch input of a finger or touch pen of a user may be installed at a lower side of the keypad receiving groove 102. A selection key 104 or a function key 105, etc. for touch input may be variously disposed at a lower end of the touch pad 103.

The first case frame 10 may include a plurality of inner side walls 111 which extend from the front surface 101 and are formed to incline in a direction of the keypad receiving groove 102. Each of the inner side walls 111 may be formed in a certain length such that the user of the electronic device 1 uses the keypad 11 easily. A plurality of supporting parts 12 for connecting with the hinge part 20 and rotating the second case frame 30 at regular angles may be formed at an upper side of the first case frame 10. Each of the supporting parts 12 may be formed as various shapes to correspond to the hinge part 20. It is possible that the supporting parts 12 are not disposed in the first case frame 10.

The second case frame 30 may have a shape corresponding to the shape of the first case frame 10. An external side of the second case frame 30 may also be formed to be extended without a stepped difference. The second case frame 30 may be pinned with the hinge part 20 to rotate at regular angles, and may rotate in an arrow direction of FIG. 1 through the hinge part 20. This second case frame 30 may be disposed by a method of putting it on the first case frame 10. At least a part of the second case frame 30 may be overlapped with the keypad 11 of the first case frame 10.

The second case frame 30 is described as "closed" when it rotates based on the first case frame 10 and is then in a state where it is overlapped with the keypad 11 of the first case frame 10. The second case frame 30 is described as "opened" when it rotates based on the first case frame 10 and the keypad 11 of the first case frame 10 is in a state as illustrated in FIG. 1 where it is easily used by a touch.

A display module 31 for data input and output may be disposed on a front surface of the second case frame 30. A proximity sensor 32, a camera device 33, etc. for sensing whether the second frame 30 is opened or closed may be disposed at an upper side of the display module 31.

The hinge part 20 may be extended from the first case frame 10 and be integrated with it. The hinge part 20 may include an electric connection means for electrically connecting the first case frame 10 with the second case frame 30. Although it is not illustrated in FIGS. 1 and 2, the electronic connection means extended from one end of the hinge part 20 may be a Flexible Printed Circuit (FPC) or cable, etc. The first case frame 10 and the second case frame 30 may be electrically coupled by this electric connection means.

The microphone device may be installed in a certain position 210 of the hinge part 20 or a certain position 220 of the first case frame 10 of the electronic device 1. The microphone device may be configured in a position which is not visually exposed. The microphone device may include one or more microphone devices. When the one or more microphone devices are installed in the hinge part 20, they may be disposed in certain positions 211, 212 of the hinge part 20 where the first case frame 10 and the second case frame 30 are adjacent. For example, the microphone devices may be installed at a position which is spaced apart from the center of the hinge part 20 at about 3.5 cm on the left or right. When the one or more microphone devices are installed in the first case frame 10, they may disposed in certain positions 221, 222, 223, 224 of the plurality of inner side walls 111 which extend from the front surface 101 of the first case frame 10 and are formed to incline in a direction of the keypad receiving groove 102. When a pair of microphone devices is installed in the plurality of inner side walls 111, the pair of microphone devices is disposed in positions facing each other.

Figure 3A:
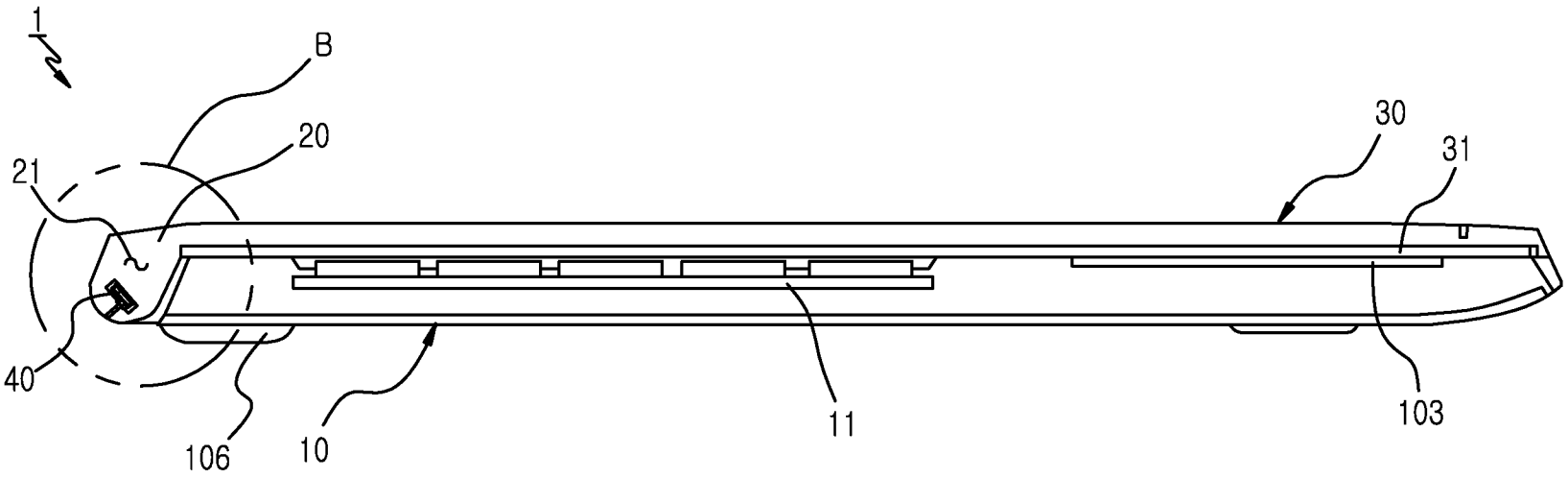
FIGS. 3A and 3B illustrate a side plan view of an electronic device where a microphone device is applied to a hinge part according to an embodiment of the present invention.
Figure 3B:
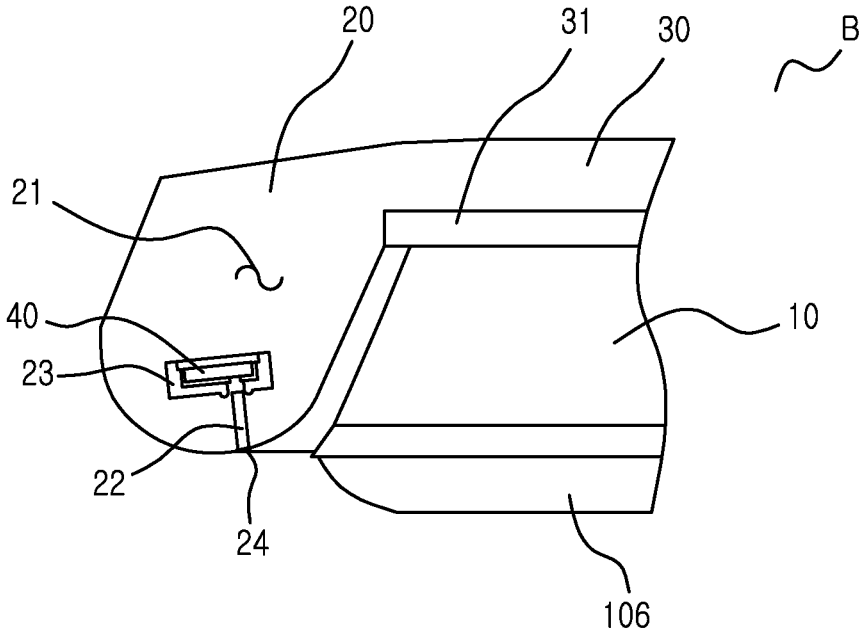

FIGS. 3A and 3B illustrate a side plan view of the electronic device where a microphone device is applied to a hinge part according to an embodiment of the present invention.

Referring to FIGS. 1 and 3A, the electronic device 1 is in a closed state in which the second case frame 30 rotates and is then overlapped with the first case frame 10. In this case, the keypad 11 and the touch pad 103 of the first case frame 10 are not exposed to the outside. The display module 31 of the second case frame 30 may be disposed to be faced with an external side of the first case frame 10. Also, a supporting member 106 for supporting the electronic device 1 may be further disposed on a lower portion of the first case frame 10.

FIG. 3B illustrates a partially enlarged portion of the area within reference number B of FIG. 3A.

Referring to FIGS. 1 and 3B, a microphone device 40 may be installed in an internal space 21 of the hinge part 20. The hinge part 20 may be extended from the second case frame 30 and be then integrated with it. The microphone device 40 may be fixed by a bushing 23 formed or installed in the internal space 21 of the hinge part 20 and be configured to electrically connect to a board of the electronic device 1. The microphone device 40 may receive external voices or sounds through a microphone hole 24 of a certain shape, which is formed in a space from the internal space 21 of the hinge part 20 to an external surface of the hinge part 20. A guide means 22 for guiding voices or sounds collected through the microphone hole 24 in a direction of the microphone device 40 may be further installed or formed between the microphone device 40 and the microphone hole 24. This guide means 22 may be formed in the second case frame 30 by injection molding.

When the electronic device 1 is in a closed state, because the microphone hole 24 is positioned at a lower side of the hinge part 20, it is not visually exposed. Accordingly, the microphone hole 24 may not interfere with the appearance of the electronic device 1 and reduce damage to foreign substances such as water or dust which flows into the microphone hole 24.

The microphone hole 24 is formed in the hinge part 20 formed in the second case frame 30. However, the microphone hole 24 may be formed in a corresponding position of the first case frame 10, which is not exposed although the hinge part 20 rotates.

The first case frame 10 and the second case frame 30 have, but are not limited to, a composition in which they are folded to be rotatable from each other. For example, the microphone hole 24 may be disposed in a combination portion of two or more case frames, which is not visually exposed, in a composition where the two or more case frames are combined to be rotatable from each other.

The first case frame 10 and the second case frame 30 have, but are not limited to, a composition in which they rotate in a mutually foldable type. For example, the microphone hole 24 may be disposed in a portion, which is not visually exposed, among combination portions of at least two case frames which are configured in various rotating types such as a sliding type, a pop-up type, and a swivel type.

Figure 4:
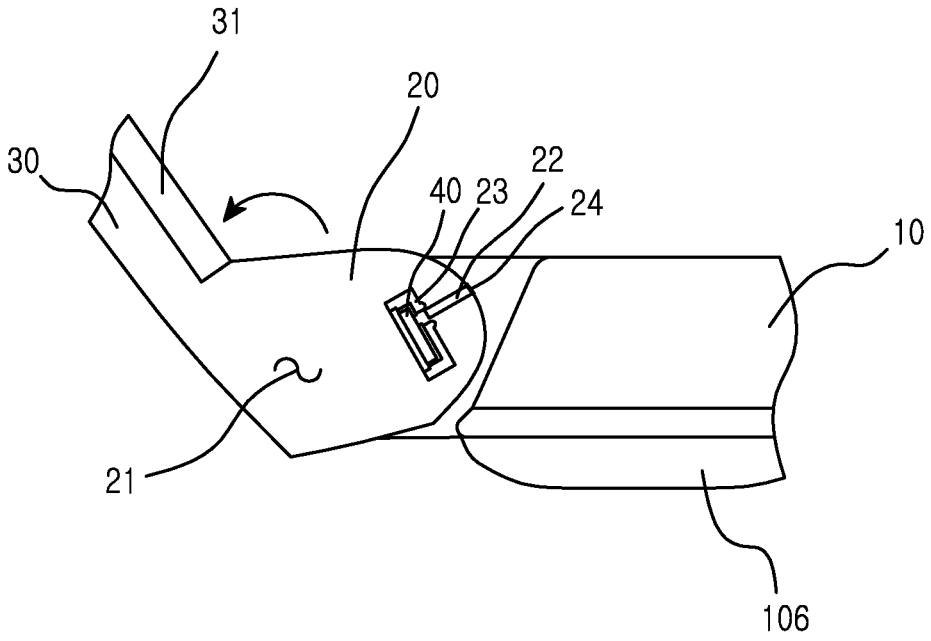
FIG. 4 illustrates a portion of a side plan view of an electronic device where a microphone device is applied to a hinge part in an open state according to an embodiment of the present invention.

FIG. 4 illustrates a portion of a side plan view of the electronic device where a microphone device is applied to a hinge part in an open state according to an embodiment of the present invention.

Referring to FIGS. 1, 3B, and 4, the electronic device 1 is in a state where the second case frame 30 rotates at a regular angle and the display module 31 may be used. The microphone device 40 may be installed in the internal space 21 of the hinge part 20. The hinge part 20 may be extended and formed from the second case frame 30. The microphone device 40 may have a plurality of microphone units. Each of the plurality of microphone units may be fixed by the bushing 23 formed or installed in the internal space 21 of the hinge part 20 and be configured to electrically connect to a board of the electronic device 1. This microphone device 40 may receive external voices or sounds through the microphone hole 24 of the certain shape, which is formed in a space from the internal space 21 of the hinge part 20 to an external surface of the hinge part 20. The guide means 22 for guiding voices or sounds collected through the microphone hole 24 in a direction of the microphone device 40 may be further installed or formed between the microphone device 40 and the microphone hole 24. This guide means 22 may be formed in the second case frame 30 by injection molding.

When the electronic device 1 is in an open state, because the microphone hole 24 is positioned at a side surface of the hinge part 20, it is not visually exposed. Also, because the microphone device 40 has a shape which is used to maximally suppress peripheral noises, it may guide the electronic device 1 to receive accurate voices.

The microphone hole 24 may be disposed, as illustrated in FIG. 4, in a position of the hinge part 20, which is not visually exposed to the outside, even if the second case frame 30 is placed in a maximum open or closed position from the first case frame 10.

When the second case fame 30 is placed in a maximum closed or opened position, if the microphone hole 24 is in a state where it may be exposed, a separate member which may conceal the microphone hole 24 may be installed or be integrated with a corresponding case frame in which the microphone hole 24 is not formed.

Figure 5:
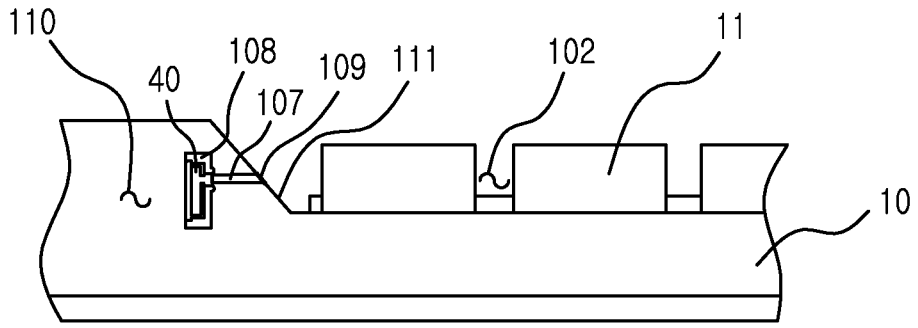
FIG. 5 illustrates a portion of a side plan view of an electronic device where a microphone device is applied to a first case frame according to an embodiment of the present invention.

FIG. 5 illustrates a portion of a side plan view of the electronic device where a microphone device is applied to a first case frame according to an embodiment of the present invention.

Referring to FIGS. 1, 3B, and 5, the microphone device 40 may be installed in an internal space 110 of the first case frame 10. One or more microphone devices 40 may be installed in the plurality of inner side walls 111 which are extended from the first case frame 10 and are formed to incline in a direction of the keypad receiving groove 102. The microphone device 40 may have a plurality of microphone units. Each of the plurality of microphone units may be fixed by a bushing 108 formed or installed in the internal space 110 of the first case frame 10 and be configured to electrically connect to a board of the electronic device 1. This microphone device 40 may receive external voices or sounds through a microphone hole 109 of a certain shape, which is formed in the inner side walls 111 of the first case frame 10. A guide means 107 for guiding voices or sounds collected through the microphone hole 109 in a direction of the microphone device 40 may be further installed or formed between the microphone device 40 and the microphone hole 109. This guide means 107 may be formed in the first case frame 10 by injection molding.

Because the microphone hole 109 of the electronic device 1 is positioned in the inner side walls 111 of the first case frame 10, it is not visually exposed. Also, because the microphone device 40 has a shape which is used to suppress peripheral noises maximally, it may guide the electronic device 1 to receive accurate voices.

In accordance with one embodiment of the present invention, at least one microphone hole has, but is not limited to, a composition in which it is disposed in a position which is not visually exposed in a case frame. If a speaker device or a receiver instead of the microphone device is installed, a speaker hole instead of the microphone hole may be formed by the same composition.

While the present invention has been particularly shown and described with reference to certain embodiments thereof, it will be understood by those skilled in the art that various changes in form and details may be made therein without departing from the spirit and scope of the present invention as defined by the appended claims.

What is claimed is:

1. An electronic device comprising:

a first case frame;

a second case frame rotatably coupled to the first case frame, wherein one end of the second case frame is hinge-connected to the first case frame so that the first case frame and the second case frame are allowed to be opened and closed, and includes an internal space and at least one hole connected with the internal space; and a sound device placed in the internal space to communicate sound to or from outside of the electronic device via the at least one hole, wherein, when the first case frame and the second case frame are closed, the at least one hole is positioned at a lower side of the one end of the second case frame, and when the first case frame and the second case frame are opened, the at least one hole is positioned at a side surface of the one end of the second case frame so that the at least one hole is covered by the first case frame.

2. The electronic device of claim 1, wherein the first case frame includes a keypad.

3. The electronic device of claim 2, wherein the first case frame includes a groove where the keypad is disposed.

4. The electronic device of claim 3, wherein the groove includes:

a bottom portion where the keypad is disposed; and a side portion extending from an edge of the bottom portion and surrounding the keypad, wherein the side portion includes a second internal space and at least one second hole connected with the second internal space.

5. The electronic device of claim 4, wherein the side portion includes at least one second sound device placed in the second internal space to communicate sound to or from outside of the electronic device via the at least one second hole.

6. The electronic device of claim 5, wherein the side portion includes a tapered surface.

7. The electronic device of claim 2, wherein the first case frame further includes a touch pad.

8. The electronic device of claim 2, wherein the second case frame includes a display.

* * * * *